US007195444B2

(12) United States Patent
Brault et al.

(10) Patent No.: US 7,195,444 B2
(45) Date of Patent: Mar. 27, 2007

(54) TURBOMACHINE WITH A DECOUPLING DEVICE COMMON TO FIRST AND SECOND BEARINGS OF ITS DRIVE SHAFT, COMPRESSOR COMPRISING THE DECOUPLING DEVICE AND DECOUPLING DEVICE

(75) Inventors: Michel Gilbert Roland Brault, Boussy Saint-Antoine (FR); Patrick Charles Georges Morel, Chartrettes (FR); Zoltan Zsiga, Avon (FR); Gael Bouchy, La Chapelle Iger (FR); Pierre Bruno Pandelakis, Melun (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/281,377

(22) Filed: Nov. 18, 2005

(65) Prior Publication Data

US 2006/0110244 A1 May 25, 2006

(30) Foreign Application Priority Data

Nov. 19, 2004 (FR) ..... 04 12296

(51) Int. Cl.
*F01D 21/00* (2006.01)

(52) U.S. Cl. ..... 415/9; 416/2; 60/223; 60/39.091

(58) Field of Classification Search ..... 415/9, 415/119, 229; 416/2, 170 R; 60/223, 39.091
See application file for complete search history.

(56) References Cited

U.S. PATENT DOCUMENTS

| | | | | |
|---|---|---|---|---|
| 6,009,701 | A | 1/2000 | Freeman et al. | |
| 6,098,399 | A * | 8/2000 | Richards et al. | 60/223 |
| 6,109,022 | A * | 8/2000 | Allen et al. | 60/223 |
| 6,240,719 | B1 * | 6/2001 | Vondrell et al. | 60/223 |
| 2005/0117828 | A1 | 6/2005 | Bouchy et al. | |

FOREIGN PATENT DOCUMENTS

| | | |
|---|---|---|
| FR | 2 752 024 | 2/1998 |
| FR | 2 831 624 | 5/2003 |
| FR | 2 832 195 | 5/2003 |

* cited by examiner

*Primary Examiner*—Edward K. Look
*Assistant Examiner*—Dwayne J White
(74) *Attorney, Agent, or Firm*—Oblon, Spivak, McClelland, Maier & Neustadt, P.C.

(57) ABSTRACT

The invention relates to a turbomachine comprising a rotor with a drive shaft centered on the axis of the turbomachine by a first bearing and a second bearing which bearings are supported respectively by a first-bearing-support piece and a second-bearing-support piece which are secured to one another and connected to the turbomachine fixed structure by a decoupling device.

This turbomachine comprises means designed to collaborate with at least one element of the turbomachine fixed structure in order to perform a dual function, that of preventing the bearing supports, from rotating and that of radially retaining the drive shaft in the event of the bearings becoming decoupled.

21 Claims, 2 Drawing Sheets

TURBOMACHINE WITH A DECOUPLING DEVICE COMMON TO FIRST AND SECOND BEARINGS OF ITS DRIVE SHAFT, COMPRESSOR COMPRISING THE DECOUPLING DEVICE AND DECOUPLING DEVICE

The invention relates to the field of turbomachines with a decoupling device common to the first and second bearings of its drive shaft.

A turbofan engine comprises, from the upstream to the downstream end when considering the direction in which the gases flow, a fan, one or more compressor stages, a combustion chamber, one or more turbine stages and a gas exhaust nozzle. The fan comprises a rotor provided with blades at its periphery which blades, when rotated, drive air into the turbofan engine. The fan rotor is supported by a low-pressure rotor shaft of the engine. It is centered on the axis of the turbofan engine by means of a first bearing which is upstream of a second bearing, the two bearings being connected to the turbofan engine fixed structure, particularly to the intermediate casing.

In the remainder of the description, in as much as the fan is mounted secured to the compressor shaft, which is the low-pressure rotor shaft in a twin spool engine, this shaft, or any other shaft secured to it, will simply be termed the compressor shaft.

The first bearing is supported by a support piece, forming a casing around the compressor shaft, facing towards the downstream end of the first bearing and fixed to a fixed structure of the turbofan engine. The second bearing is supported by a support piece also fixed to a fixed structure of the turbofan engine.

By way of an accidental phenomenon, a fan blade may become lost. This then results in significant imbalance on the compression shaft and leads to loadings and vibrations on the bearings, these being transmitted by their support pieces to the fixed structures of the turbofan engine, which have therefore to be engineered accordingly.

This engineering leads to additional costs and increases the mass of the turbofan engine. To reduce these it is possible, as in patent FR 2, 752, 024, to propose a system for decoupling the bearings. The support pieces for the first bearing and for the second bearing, in this instance secured to one another, are fixed to the structure of the turbofan engine by screws known as rupture screws, comprising a weakened portion that causes them to break if the forces become too high. Thus, when imbalance appears on the compressor shaft, the forces introduced onto the bearings are transmitted to the rupture screws which break, decoupling the bearing support pieces from the fixed structure of the turbofan engine. The forces brought about by the imbalance are then no longer transmitted to the fixed structure of the turbofan engine by these support pieces.

Once the bearing supports have been decoupled from the fixed structure of the turbofan engine, significant radial movements of the compressor shaft occur. Document FR 2, 752, 024 proposes, with a view to limiting such movements, providing pieces that form false bearings for the bearing supports, which rotate and swing with the shaft when decoupled from the fixed structure; in that particular instance we are talking about a rib, secured to the fixed structure, running transversely to the axis of the turbofan engine and ending in shoes surrounding the compressor shaft, or of a rib surrounding the first-bearing support. However, the swinging of the bearing supports with the drive shaft gives rise to considerable forces, and their inertia, together with the lever arm they represent with respect to the axis of the turbofan engine is large. It is therefore desirable to install, on a turbofan engine with a decoupling device, an emergency bearing support rather than an emergency bearing, or false bearing, for the bearing supports. In other words, it is desirable to replace the false bearing that the rib of document FR 2, 752, 024 constitutes, which is a false bearing against which the bearing support pieces bear, with an emergency bearing support collaborating with the outer rings of the bearings, which would therefore be closer to the bearings and to the axis of the turbofan engine.

Thus, the invention relates to a turbomachine comprising a rotor with a drive shaft centered on the axis of the turbomachine by a first bearing and a second bearing which bearings are supported respectively by a first-bearing-support piece and a second-bearing-support piece which are secured to one another and connected to the turbomachine fixed structure by a decoupling device, characterized in that it comprises means designed to collaborate with at least one element of the turbomachine fixed structure in order to perform a dual function, that of preventing the bearing supports from rotating and that of radially retaining the drive shaft in the event of the bearings becoming decoupled.

The functions of preventing the bearing supports from rotating and of radially retaining the drive shaft, when combined, do indeed perform an emergency bearing support function.

Furthermore, once the bearings have been decoupled, there is a risk that the compressor shaft will break, and this would lead to the fan escaping forwards. In order to guard against such a danger, patent application FR 04 01 105 proposes to provide a circumferential rib on the compressor shaft, near the second bearing, collaborating with a web of the fixed structure in order to perform a function of axially retaining the fan. However, if the compressor shaft breaks upstream of this rib, the retaining function is not performed. Furthermore, in this turbofan engine, the two bearings each have their own decoupling device, which increases its complexity.

Advantageously, the said means are then designed to perform a third function, that of axially retaining the rotor in the event of the drive shaft breaking.

Thus, axial retention of the rotor may be had irrespective of the position at which the drive shaft breaks, downstream of the first bearing, because the first and second bearing support pieces are secured to each other.

As a preference, the means are arranged on the second-bearing support piece.

Also as a preference, the said means are designed not to hamper the longitudinal movements of the drive shaft during the decoupling dynamics.

The invention also relates to a device providing decoupling between a turbomachine fixed structure set out hereinabove and a first and a second part, secured to one another and forming supports for a first bearing and a second bearing of a turbomachine rotor drive shaft, characterized in that it comprises means designed to collaborate with at least one element of the turbomachine fixed structure in order to perform a dual function, that of preventing the bearing supports from rotating and that of radially retaining the drive shaft in the event of the bearings becoming decoupled.

The invention also relates to a turbomachine compressor comprising a rotor with a drive shaft centered on the axis of the turbomachine by a first bearing and a second bearing, which bearings are respectively supported by a first-bearing-support piece and by a second-bearing-support piece which support pieces are secured to one another and connected to the turbomachine fixed structure by a decoupling device, characterized in that it comprises means designed to collaborate with at least one element of the turbomachine fixed structure in order to perform a dual function, that of preventing the bearing supports from rotating and that of radially retaining the drive shaft in the event of the bearings becoming decoupled.

The invention will be better understood with the aid of the following description of the turbomachine of the invention, with reference to the attached plates, in which.

Figure 1:
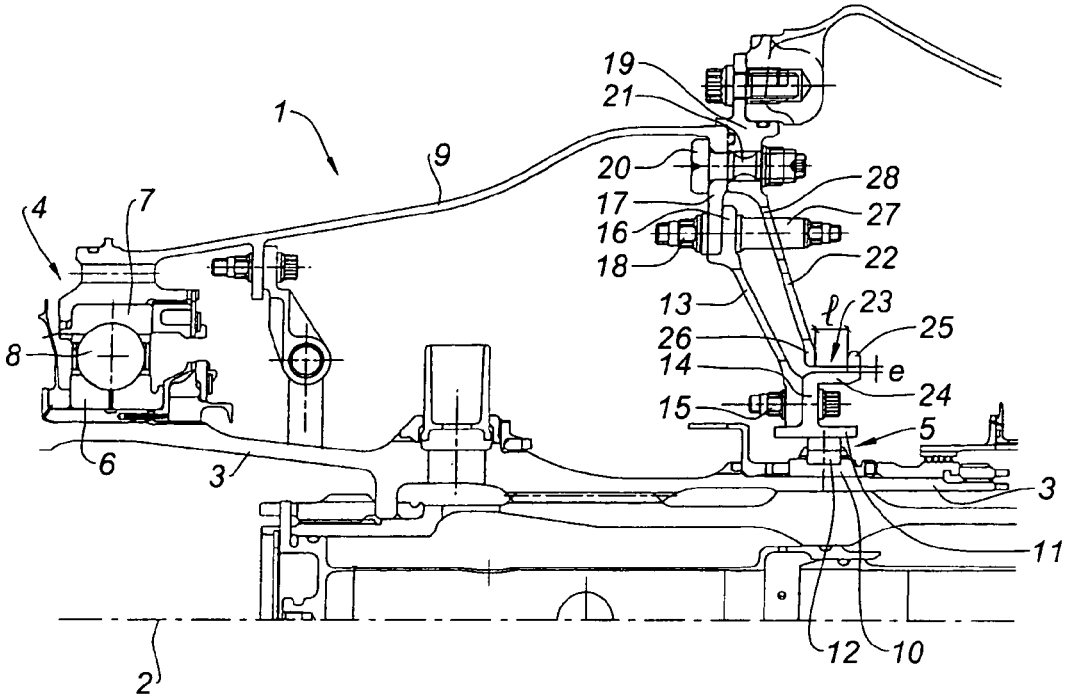
FIG. 1 depicts a schematic view in axial section of a first embodiment of the turbomachine of the invention.

With reference to FIG. 1, the turbomachine here is a turbofan engine 1 which comprises, in its first embodiment, a rotor, not depicted, termed the fan, which comprises blades extending radially about the axis 2 of the turbofan engine. The fan shaft is fixed, downstream of the blades, to the compressor shaft 3. The expressions upstream and downstream are to be understood as meaning upstream and downstream in the direction in which the gases flow. In this instance, the shaft is the low pressure compressor shaft. The combination of the fan shaft and of the compressor shaft 3, and any other shaft secured to it will be noted hereinafter as the compressor shaft 3 or the drive shaft 3. The compressor shaft 3 is supported by a first bearing 4 and a second bearing 5 located downstream of the first bearing 4.

The first bearing 4 comprises an inner ring 6 and an outer ring 7, between which rings balls 8 or other rolling members are mounted. The inner ring 6 is mounted secured to the compressor shaft 3 and the outer ring 7 secured to a first-bearing-support piece 9 hereinafter termed first-bearing support 9. The first-bearing support 9 extends, from the first bearing 4, downstream. It is a frustoconical shape overall, its diameter increasing in the downstream direction and is connected downstream to the fixed structure of the turbofan engine 1, as will be seen later on. The balls 8 allow the inner ring 6 and therefore the compressor shaft 3 to rotate with respect to the outer ring 7 and therefore with respect to the first bearing support 9 and with respect to the fixed structure of the turbofan engine 1.

The second bearing 5 comprises an inner ring 10 and an outer ring 11 between which rings rollers 12 or other rolling members are mounted. The inner ring 10 is mounted secured to the compressor shaft 3 and the outer ring 11 is mounted secured to a second-bearing-support piece 13 hereinafter termed the second bearing support 13 which extends, from the second bearing 5, upstream. The outer ring 11 of the second bearing 5 for this purpose on its outer face comprises a radial flange 14 fixed to an internal flange of the second bearing support 13 by screws 15.

The second bearing support 13 is a frustoconical shape overall, its diameter increasing in the upstream direction and at its upstream end comprises a flange 16 transverse to the axis 2 of the turbofan engine. The first bearing support 9 comprises at its downstream end, a transverse flange 17 running radially inwards, and to which there is fixed, for example using screws 18, the flange 16 of the second bearing support 13. The supports 9, 13 of the first and second bearings 4, 5 are thus secured to one another.

The flange 17 of the first bearing support 9 is fixed to the fixed structure of the turbofan engine 1, in this instance to a flange 19 of a casing known as the intermediate casing, by rupture screws 20 situated on the outside of the screws 18 used to fix the first and second bearing supports 9, 13. These rupture screws 20 comprise a frangible portion 21 forming an area promoting failure in tension, and weighted to break if determined tensile loads are applied. This frangible portion 21 is obtained in this instance by calibrated thinning-down of the shank of the screws 20. The screws 20 thus form a decoupling device common to the first and second bearings 4, 5, which are secured, from the fixed structure of the turbofan engine 1.

The rollers 12 of the second bearing 5 are mounted parallel to the axis 2 of the turbofan engine 1, in a groove running at the circumference of the inner ring 10, and are kept spaced apart by a squirrel cage, a description of which will not be detailed here because it is well known to those skilled in the art. They allow the inner ring 10 to rotate with respect to the outer ring 11 and therefore allow the compressor shaft 3 to rotate with respect to the fixed structure of the turbofan engine 1.

Extending downstream from the second bearing support 13, radially inwards and slightly in the downstream direction from the flange 19 of the intermediate casing there is a web 22 of frustoconical overall shape, its diameter reducing in the downstream direction. Fixed to the radial flange 14 of the outer ring 11 of the second bearing 5, at its outer end, is a ring 23 of L-shaped cross section collaborating with the fixed structure of the turbofan engine 1 in order here to perform a dual function, that of axially retaining the compressor shaft 3 in the event of the bearings 4, 5 being decoupled and that of axially retaining the fan in the event of the compressor shaft 3 breaking. This ring 23 in this instance is formed of a single piece with the radial flange 14 and comprises a longitudinal portion 24, forming the long leg of the L-shaped cross section, extending downstream from the outer end of the radial flange 14, and a radial portion 25 running radially outwards from the downstream end of the longitudinal portion 24.

The ring 23 of L-shaped cross section is designed to collaborate with the inner end portion 26 of the web 22 to perform its dual function, that of radially retaining the compressor shaft 3 via its longitudinal portion 24, and that of axially retaining the fan via its radial portion 25.

To achieve this, the outer wall of the longitudinal portion 24 of the ring 23 lies at a distance "e" from the inner wall of the end portion 26 of the web 22, the distance "e" being calibrated in such a way that these two walls come into contact, in the event of the bearings being decoupled, if the radial amplitude of the movements of the compressor shaft 3 exceeds a certain threshold; the movements of the shaft 3 thus being limited, the movements of the fan are limited. During normal operation of the turbofan engine 1 there is no contact between the wall of the longitudinal portion 24 of the ring 23 and the web 22.

Furthermore, the upstream wall of the radial portion 25 of the ring 23 lies a distance "l" from the downstream wall of the end portion 26 of the web 22, which distance "l" is calibrated such that these two walls come into contact, in the event of the compressor shaft 3 breaking, to perform a function of axially retaining the fan. It may be noted that a breakage may occur at any point along the compressor shaft 3, downstream of the first bearing 4. Indeed, assuming that the bearings 4, 5 are decoupled and that the compressor shaft 3 breaks between the two bearings 4, 5, the fan, which continues to turn, is driven forwards with the portion of the compressor shaft 3 still attached to it. This portion drives the first bearing 4 forwards and therefore, because the pieces are secured to each other, drives forwards the first bearing support 9, the second bearing support 13, the radial flange 14 of the outer ring 11 of the second bearing 5 and therefore the ring 23 of L-shaped cross section, the radial portion 25 of which comes into abutment against the end portion of the web 22 secured to the fixed structure of the turbofan engine 1. The fan is thus retained. The same thing happens if the breakage occurs downstream of the second bearing, the entire portion of the compressor shaft 3 lying between the two bearings 4, 5 then being driven forwards with the ring 23 of the radial flange 14 of the second bearing 5.

The distances "l" and "e" are calibrated such that the radial portion 25 of the ring 23 does not come into abutment against the end portion 26 of the web 22 during the decoupling phase. Indeed, during this phase, the compressor shaft 3 is not turning about its axis and may perform movements that have longitudinal components. In particular, when a blade breaks, the imbalance caused results, temporarily, in a rotational movement of the compressor shaft 3 about the first rupture screw 20 which breaks. The distance "l" is large enough for abutment of the radial portion 25 of the ring 23 against the web 22 not to occur, when the turbofan engine 1 is operating normally or during a decoupling phase.

Rotation-proofing fingers 27 are also arranged on the second bearing support 13. They extend longitudinally backwards from the fixing screws 18 used to secure the supports 9, 13 of the first and second bearings 4, 5 to each other. These fingers 27 extend through orifices 28 formed in the web 22 and collaborate with them, in the event of the decoupling of the bearings 4, 5, to prevent the bearing supports 9, 13 and therefore the outer rings of the first and second bearings 4, 5, from rotating about the axis 2 of the turbofan engine 1; the fingers 27 in fact come into abutment against the walls of the orifices 28 in the web 22, which is secured to the fixed structure of the turbofan engine 1. Clearance is provided between the fingers 27 and their through-orifices 28, so as not to disturb the dual function of the ring 23 of L-shaped cross section and so as not to impede the decoupling dynamics.

The way in which the turbofan engine 1 works when a fan blade is lost will now be explained in greater detail.

The loss of a blade during operation of the turbofan engine 1, and therefore when the fan is turning, leads to imbalance on the compressor shaft 3. The forces induced cause the rupture screws 20 that secure the supports 9, 13 of the first and second bearings 4, 5 to the fixed structure of the turbofan engine 1 to break at their frangible portion 21. In this particular instance, the frangible portion 21 of the screws 20 forms a region where tensile failure is encouraged, whereas the imbalance on the compressor shaft 3 is essentially radial; in fact, the radial loadings on the shaft 3 translate at the screws 20 into longitudinal loadings, particularly via the first bearing support 9.

Throughout the decoupling dynamics, the movements of the compressor shaft 3 are radially limited by the collaboration between the longitudinal portion 24 of the ring 23 of L-shaped cross section and the end portion 26 of the web 22. The radial portion 25 of the ring 23 does not interfere with these decoupling dynamics because of the size of the distance "l".

Once all the rupture screws 20 are broken, the first bearing support 9 and the second bearing support 13 are decoupled from the flange 19 of the intermediate casing and therefore from the fixed structure of the turbofan engine 1. The forces associated with the imbalance are then no longer transmitted to the latter by the bearing supports 9, 13 and the compressor shaft 3 can rotate freely about its axis 2, its movements being radially limited by the ring 23 of L-shaped cross section collaborating with the web 22. The bearing supports 9, 13 are prevented from rotating by the rotation-proofing fingers 27 described above. Thus, the ring 23 of L-shaped cross section and the rotation-proofing fingers 27 in collaboration with the web 22 perform an emergency bearing support function because they perform a function of radially retaining the compressor shaft 3, with a piece, the ring 23, secured to the outer ring 11 of the second bearing 5, prevented from rotating about the axis 2 of the turbofan engine by the second bearing support 5 and allowing the compressor shaft 3 to rotate.

However, following the loss of a blade, the compressor shaft 3 may break. If it does, the rotation of the fan drives the compressor shaft 3 secured to it forwards. The radial portion 25 of the ring 23 of L-shaped cross section, then performs a function of axially retaining the fan, as was seen above. The fan is therefore no longer expelled from the turbofan engine 1.

Thus, the ring 23 and the rotation-proofing fingers 27 are designed, with the web 22, to perform an emergency bearing support function, additionally performing the function of axially retaining the fan.

Figure 2:
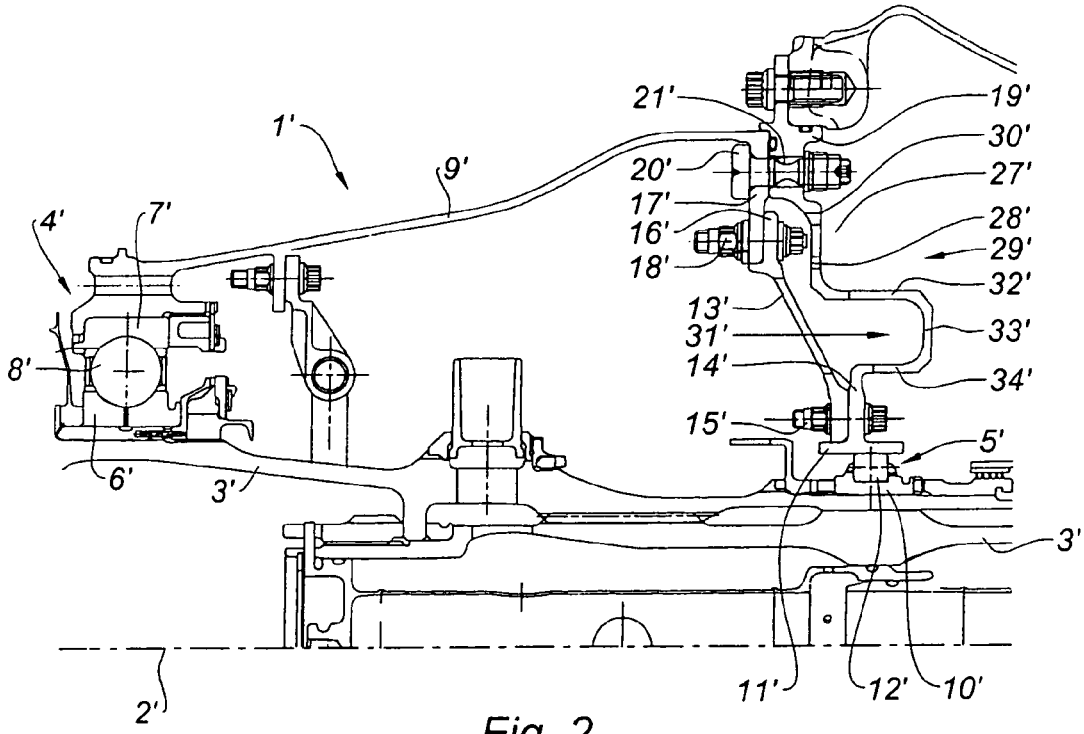
FIG. 2 depicts a schematic view in axial section of a second embodiment of the turbomachine of the invention.

With reference to FIG. 2 in which the references denoting components similar to those of FIG. 1 are given the same numeral followed by a "prime" symbol, the turbofan engine 1' also comprises, in its second embodiment, a fan, mounted to rotate above the axis 2' of the turbofan engine and driven by a drive shaft 3' which is the compressor shaft 3' supported by a first bearing 4' and a second bearing 5' situated downstream of the first bearing 4'. The first bearing 4' comprises an inner ring 6' secured to the drive shaft 3' and an outer ring 7' secured to a first bearing support 9', between which rings balls 8' or other rolling members are mounted. The first bearing support 9', of frustoconical overall shape, extends downstream where it comprises a downstream flange 17' fixed to a flange 19' of the intermediate casing by rupture screws 20' forming a device for decoupling the bearings 4', 5', by virtue of their frangible portion 21' which forms an area encouraging tensile failure.

The second bearing 5' comprises an inner ring 10' secured to the compressor shaft 3' and an outer ring 11' secured to a second bearing support 13' and between which rings rollers 12' or other rolling members are mounted. The outer ring 11' is fixed to the second bearing support 13' by a radial flange 14' projecting from its outer wall, using screws 15'.

The second bearing support 13', which is slightly frustoconical, at its upstream outer end comprises a flange 16' fixed to the downstream flange 17' of the first bearing support 13' by screws 18', on the inside of the frangible screws 20'.

Extending between the flange 19' of the intermediate casing and the radial flange 14' of the outer ring 11' of the second bearing 5' is a web 29' for preventing the bearing supports 9', 13' from rotating and for radially retaining the compressor shaft 3' in the event of decoupling, and for axially retaining the fan in the event of the compressor shaft 3' breaking. This web 29' comprises, from the flange 19' of the intermediate casing as far as the flange 14' of the outer ring 11', a portion 30' transverse to the axis of the turbofan engine and a portion 31' of U-shaped cross section with a longitudinal outer branch 32', a transverse base 33' and a longitudinal inner branch 34', the base 33' of the U being situated at the downstream end. The portion 31' of U-shaped cross section, hereinafter termed the U-shaped portion 31', extends between the inner end of the transverse portion 30' and the outer end of the radial flange 14' of the ring 11', to both of which it is secured.

It is particularly the portion 31' of U-shaped cross section which here performs the triple function of preventing the bearing supports 9', 13' from rotating, of radially retaining the compressor shaft 3' while the bearings 4', 5' are decoupling, and of axially retaining the fan in the event of the compressor shaft 3' breaking. The web 29' has no impact on the normal operation of the turbofan engine 1'.

For this purpose, the U-shaped portion 31' is sized so that it exhibits a certain degree of radial flexibility, which is obtained by elasticity between its two branches 32', 34' but it has enough strength to perform a function of radially retaining the compressor shaft 3' during the dynamics of the uncoupling of the bearings 4', 5'. This portion 31' is also rigid in torsion, so as to provide a function of preventing the rotation of the bearing supports 9', 13' and therefore of the outer rings of the first and second bearings 4', 5', through the agency of the second bearing support 13', to which it is secured by the flange 14' of the outer ring of the second bearing 5'. Furthermore, this portion is calibrated such that it exhibits a certain degree of axial flexibility, in this instance greater flexibility than the radial flexibility so as not to hamper the longitudinal movements of the drive shaft during the dynamics of the uncoupling of the bearings 4', 5', but is strong enough to perform a function of axially retaining the fan if the compressor shaft 3' breaks.

The analogy between, on the one hand, the flexibility and radial strength of the U-shaped portion 31' and the distance "e" of the turbofan engine of FIG. 1 and, on the other hand, the flexibility and axial strength of the U-shaped portion 31' and the distance "l" of this turbofan engine may be noted. During the decoupling phase, the longitudinal movements of the compressor shaft 3' are permitted to a certain extent, as they are in the embodiment of FIG. 1.

It will be noted that the function of preventing the bearing supports 9', 13' from rotating is performed here by the web 29', with no rotation-proofing fingers. The web 29' therefore, particularly by virtue of its U-shaped section, performs an emergency bearing support function in respect of the second bearing 5', because it radially retains the compressor shaft, which can turn with respect to the outer ring 11', which is prevented from rotating. It also performs a function of axially retaining the fan in the event of the compressor shaft 3' breaking.

As before, axial retention of the fan occurs in the event of breakage of the compressor shaft 3' at any point along this shaft 3', provided that the point lies downstream of the first bearing 4'. Once again, with the bearings 4', 5' decoupled, if the compressor shaft 3' breaks between the two bearings 4', 5', the fan, which continues to turn, is driven forwards with the portion of compressor shaft 3' still attached to it. This portion drives forwards the first bearing 4' and therefore, because of the pieces being secured to one another, the first bearing support 9', the second bearing support 13', the radial flange 14' of the outer ring 11' of the second bearing and therefore the web 29 with its U-shaped portion 31', which retains the whole. The fan is thus retained. The same is true if a break occurs downstream of the second bearing 5'.

The way in which the turbofan engine 1' of FIG. 2 works when it loses a fan blade is entirely comparable with the working of the turbofan engine of FIG. 1. Once again, this time by way of the web 29, an emergency bearing support is obtained which in addition performs a function of axially retaining the fan.

Figure 3:
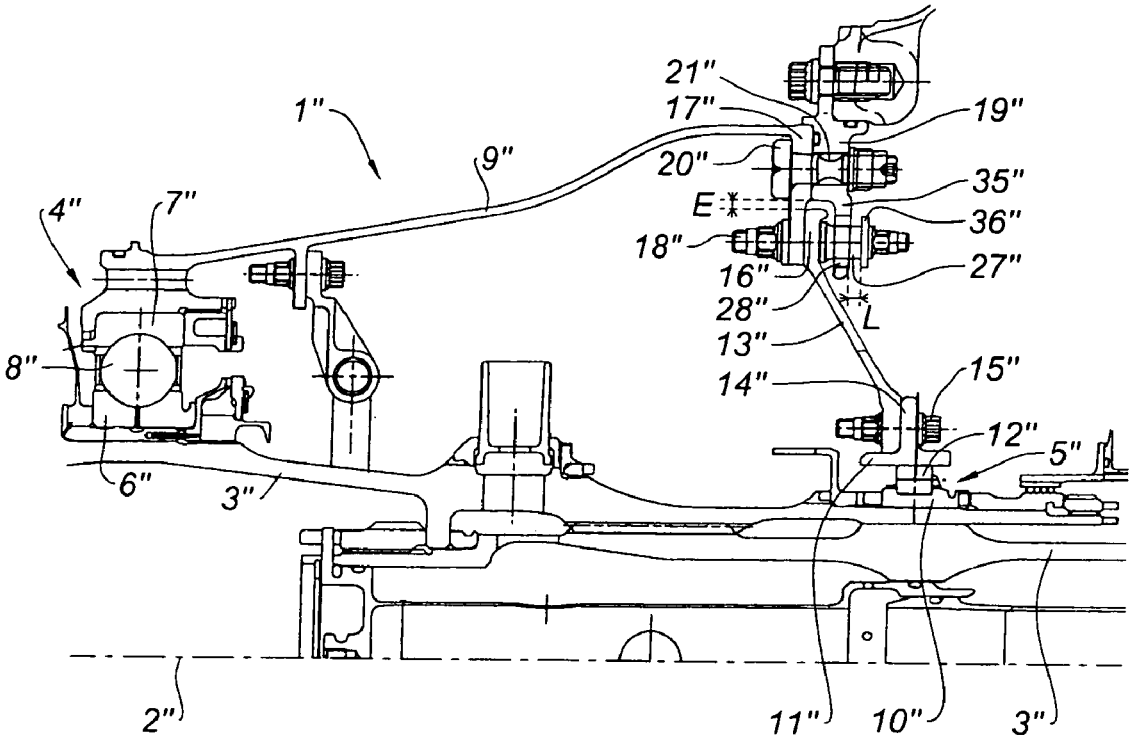
FIG. 3 depicts a schematic view in axial section of a third embodiment of the turbomachine of the invention.

With reference to FIG. 3 in which the references denoting components similar to those of FIG. 1 are given the same numeral followed by a double "prime" symbol, the turbofan engine 1" also comprises, in its second embodiment, a fan mounted to rotate about the axis 2" of the turbofan engine and driven by a drive shaft 3" which is the compressor shaft 3" supported by a first bearing 4" and a second bearing 5" situated downstream of the first bearing 4". The first bearing 4", comprises an inner ring 6" secured to the drive shaft 3" and an outer ring 7" secured to a first bearing support 9" between which rings balls 8" or other rolling members are mounted. The first bearing support 9", of frustoconical overall shape, extends downstream, where it comprises a downstream flange 17" fixed to a flange 19" of the intermediate casing by rupture screws 20" forming a device for decoupling the bearings 4', 5', by virtue of their frangible portion 21" that forms a region encouraging tensile failure.

The second bearing 5" comprises an inner ring 10" secured to the compressor shaft 3" and an outer ring 11" secured to a second bearing support 13", between which rings rollers 12" or other rolling members are mounted. The outer ring 11" is fixed to the second bearing support 13" by virtue of a radial flange 14" projecting from its outer wall, using screws 15".

The second bearing support 13", which is slightly frustoconical, at its upstream outer end comprises an outer flange 16" fixed to the downstream flange 17" of the first bearing support 13" by screws 18" positioned on the inside of the rupture screws 20".

Extending radially inwards from the flange 19" of the intermediate casing is a rib 35" transverse to the axis 2" of the turbofan engine 1", downstream of the outer flange 16" of the second bearing support 13". Rotation-proofing fingers 27" extend longitudinally backwards, from the fixing screws 18" that fix the bearing supports 9", 13" together, through orifices 28" formed in the rib 35", to prevent the bearing supports 9", 13" from rotating about the axis 2" of the turbofan engine 1" in the event of decoupling.

The outer flange 16" of the second bearing support 13" is fixed to the flange 17" of the first bearing support 9" in such a way that its outer edge is at a radial clearance "E" with respect to the inner wall of the flange 19" of the intermediate casing, upstream of the rib 35", so as to collaborate with it in order, by abutment, to perform a function of radially retaining the compressor shaft 3" in the event of decoupling of the bearings 4', 5'.

The rotation-proofing fingers 27" comprise, on their portion projecting on the downstream side of the rib 35", a flange ring 36" situated a distance "L" from the downstream wall of the rib 35" so as to perform a function of axially retaining the fan in the event of the compressor shaft 3" breaking.

The analogy between the distances "E" and "L" of the embodiment of FIG. 3 and the distances "e" and "l" of the embodiment of FIG. 1 may be noted. Once again, the rotation-proofing fingers 27" are mounted with clearance in their accepting orifices 28" so as not to impede the function, allocated to the flange 16", of radially retaining the compressor shaft 3" and the function, allocated to the flange rings 36", of axially retaining the fan. Furthermore, the distances "E" and "L" are dimensioned such that the flange rings 36" do not come to bear against the rib 35" during normal operation of the turbofan engine 1" or a phase of decoupling of its bearings 4", 5".

The way in which the turbofan engine 1" of FIG. 3 operates when a fan blade is lost is entirely comparable with the operation of the turbofan engine of FIG. 1, the function of radially retaining the compressor shaft 3" being provided by the outer edge of the flange 16" of the second bearing support 13" collaborating with the flange 19" of the intermediate casing, the function of preventing the bearing supports 9", 13" from rotating being provided by the rotation-proofing fingers 27" collaborating with the orifices 28" in the rib 35", and the function of axially retaining the fan being provided by the flange rings 36" of the fingers 27" collaborating with the downstream face of the rib 35" secured to the flange 19" of the intermediate casing. Once again we indeed have an emergency bearing support performing an additional function of axially retaining the fan.

Once again, breakage of the compressor shaft 3" may occur at any point along the compressor shaft 3", provided that it is downstream of the first bearing 4". With the bearings 4", 5" decoupled, if the compressor shaft 3" breaks between the two bearings 4", 5" the fan, which continues to turn, is driven forwards with the portion of the compressor shaft 3" still attached to it. This portion drives forwards the first bearing 4" and therefore, because the pieces are secured to one another, the first bearing support 9", the second bearing support 13" and therefore the fingers 27" with their flange ring 36", which come into abutment against the rib 35" and retain the whole. The fan is thus retained. The same is true if breakage occurs downstream of the second bearing 5".

The invention has been described in its three embodiments in conjunction with a turbofan engine, particularly a twin spool turbofan engine, the second bearing of which is a bearing supporting the low-pressure rotor. The invention applies to other types of turbomachine, such as a turboprop engine, an industrial turbocompressor or an industrial turbine, the rotor then not being a fan rotor but quite simply a rotor.

The invention claimed is:

1. Device providing decoupling between a turbomachine fixed structure and a first and a second part, secured to one another and forming supports for a first bearing and a second bearing of a turbomachine rotor drive shaft, characterized in that it comprises means designed to collaborate with at least one element of the turbomachine fixed structure in order to perform a dual function, that of preventing the bearing supports from rotating and that of radially retaining the drive shaft in the event of the bearings becoming decoupled.

2. Decoupling device according to claim 1, in which the said means are designed to perform a third function, that of axially retaining the rotor in the event of the drive shaft breaking.

3. Decoupling device according to claim 1, in which the said means are arranged on a second-bearing-support piece.

4. Decoupling device according to claim 1, in which the said means are designed not to hamper the longitudinal movements of the drive shaft during the decoupling dynamics.

5. Decoupling device according to claim 1 in which, with the second bearing comprising an inner ring and an outer ring between which rolling members are mounted, the decoupling device comprises a web, secured to the turbomachine fixed structure, with an inner end portion, and a ring, secured to the outer ring, having an L-shaped cross section, connected to the second-bearing-support piece, comprising a longitudinal portion designed to collaborate with the end portion of the web so as to perform a function of radially retaining the drive shaft, and a radial portion designed to collaborate with the end portion of the web so as to perform a function of axially retaining the rotor, fingers extending, secured to the second-bearing-support piece, through orifices in the web in order to perform a function of preventing the bearing supports from rotating.

6. Decoupling device according to claim 1 in which, with the second bearing comprising an inner ring and an outer ring connected to the second-bearing-support piece, between which rings rolling members are mounted, the decoupling device comprises a web, mounted between the fixed structure and the said outer ring, to both of which it is secured, said web comprising a portion with a U-shaped cross section designed to perform a function of preventing the bearing supports from rotating, of radially retaining the drive shaft and of axially retaining the rotor.

7. Decoupling device according to claim 1 in which, with the bearing support pieces fixed to a flange of the fixed structure, the second-bearing-support piece is designed so that its outer edge has a radial clearance (E) with respect to the said flange in order to perform a function of radially retaining the drive shaft, fingers extending, secured to the second-bearing-support piece, through orifices formed in a rib secured to the said flange in order to perform a function of preventing the bearing supports from rotating, the said fingers comprising a flange ring designed to have an axial clearance (L) with respect to the said rib and to perform a function of axially retaining the rotor.

8. Turbomachine compressor comprising a rotor with a drive shaft centered on the axis of the turbomachine by a first bearing and a second bearing, which bearings are respectively supported by a first-bearing-support piece and by a second-bearing-support piece which support pieces are secured to one another and connected to the turbomachine fixed structure by a decoupling device, characterized in that it comprises means designed to collaborate with at least one element of the turbomachine fixed structure in order to perform a dual function, that of preventing the bearing supports from rotating and that of radially retaining the drive shaft in the event of the bearings becoming decoupled.

9. Compressor according to claim 8, in which the said means are designed to perform a third function, that of axially retaining the rotor in the event of the drive shaft breaking.

10. Compressor according to claim 8, in which the said means are arranged on the second-bearing-support piece.

11. Compressor according to claim 8, in which the said means are designed not to hamper the longitudinal movements of the drive shaft during the decoupling dynamics.

12. Compressor according to claim 8, in which, with the second bearing comprising an inner ring and an outer ring between which rolling members are mounted, the fixed structure supports a web with an inner end portion and the outer ring supports a ring with an L-shaped cross section, connected to the second-bearing-support piece, comprising a longitudinal portion designed to collaborate with the end portion of the web so as to perform a function of radially retaining the drive shaft, and a radial portion designed to collaborate with the end portion of the web so as to perform a function of axially retaining the rotor, fingers extending, secured to the second-bearing-support piece, through orifices in the web in order to perform a function of preventing the bearing supports from rotating.

13. Compressor according to claim 8, in which, with the second bearing comprising an inner ring and an outer ring connected to the second-bearing-support piece, between which rings rolling members are mounted, a web is mounted between the fixed structure and the said outer ring, to both of which it is secured, the said web comprising a portion with a U-shaped cross section designed to perform a function of preventing the bearing supports from rotating, of radially retaining the drive shaft and of axially retaining the rotor.

14. Compressor according to claim 8, in which, with the bearing support pieces fixed to a flange of the fixed structure, the second-bearing-support piece is designed so that its outer edge has a radial clearance (E) with respect to the said flange in order to perform a function of radially retaining the drive shaft, fingers extending, secured to the second-bearing-support piece, through orifices formed in a rib secured to the said flange in order to perform a function of preventing the bearing supports from rotating, the said fingers comprising a flange ring designed to have an axial clearance (L) with respect to the said rib and to perform a function of axially retaining the rotor.

15. Turbomachine comprising a rotor with a drive shaft centered on the axis of the turbomachine by a first bearing and a second bearing, which bearings are respectively supported by a first-bearing-support piece and by a second-bearing-support piece which support pieces are secured to one another and connected to the turbomachine fixed structure by a decoupling device, characterized in that it comprises means designed to collaborate with at least one element of the turbomachine fixed structure in order to perform a dual function, that of preventing the bearing supports from rotating and that of radially retaining the drive shaft in the event of the bearings becoming decoupled.

16. Turbomachine according to claim 15, in which the said means are designed to perform a third function, that of axially retaining the rotor in the event of the drive shaft breaking.

17. Turbomachine according to claim 15, in which the said means are arranged on a second-bearing-support piece.

18. Turbomachine according to claim 15, in which the said means are designed not to hamper the longitudinal movements of the drive shaft during the decoupling dynamics.

19. Turbomachine according to claim 15, in which, with the second bearing comprising an inner ring and an outer ring between which rolling members are mounted, the fixed structure supports a web with an inner end portion and the outer ring supports a ring with an L-shaped cross section, connected to the second-bearing-support piece, comprising a longitudinal portion designed to collaborate with the end portion of the web so as to perform a function of radially retaining the drive shaft, and a radial portion designed to collaborate with the end portion of the web so as to perform a function of axially retaining the rotor, fingers extending, secured to the second-bearing-support piece, through orifices in the web in order to perform a function of preventing the bearing supports from rotating.

20. Turbomachine according to claim 15, in which, with the second bearing comprising an inner ring and an outer ring connected to the second-bearing-support piece, between which rings rolling members are mounted, a web is mounted between the fixed structure and the said outer ring, to both of which it is secured, said web comprising a portion with a U-shaped cross section designed to perform a function of preventing the bearing supports from rotating, of radially retaining the drive shaft and of axially retaining the rotor.

21. Turbomachine according to claim 15, in which, with the bearing support pieces fixed to a flange of the fixed structure, the second-bearing-support piece is designed so that its outer edge has a radial clearance (E) with respect to the said flange in order to perform a function of radially retaining the drive shaft, fingers extending, secured to the second-bearing-support piece, through orifices formed in a rib secured to the said flange in order to perform a function of preventing the bearing supports from rotating, the said fingers comprising a flange ring designed to have an axial clearance (L) with respect to the said rib and to perform a function of axially retaining the rotor.

* * * * *